US007262155B2

(12) United States Patent
Ryan, III et al.

(10) Patent No.: US 7,262,155 B2
(45) Date of Patent: Aug. 28, 2007

(54) HIGH OCTANE LUBRICANTS FOR KNOCK MITIGATION IN FLAME PROPAGATION ENGINES

(75) Inventors: Thomas W. Ryan, III, San Antonio, TX (US); Jack A. Smith, Spring Branch, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 10/843,864

(22) Filed: May 12, 2004

(65) Prior Publication Data

US 2004/0242436 A1 Dec. 2, 2004

Related U.S. Application Data

(60) Provisional application No. 60/469,769, filed on May 12, 2003.

(51) Int. Cl.
*C10M 159/18* (2006.01)

(52) U.S. Cl. ..... 508/383; 508/382; 508/463; 508/591

(58) Field of Classification Search ..... 508/382, 508/383

See application file for complete search history.

(56) References Cited

U.S. PATENT DOCUMENTS 3,928,218 A * 12/1975 Rowe et al. ..... 508/208
4,155,718 A * 5/1979 Graiff ..... 44/359
4,718,381 A 1/1988 McDougal et al. ..... 123/406
4,946,609 A * 8/1990 Pruess et al. ..... 508/384
4,960,542 A * 10/1990 Seiki ..... 508/496
4,981,602 A 1/1991 Ripple et al. ..... 252/32.7
4,987,873 A 1/1991 Schenk ..... 123/418
5,215,059 A 6/1993 Kaneyasu ..... 123/425
5,288,393 A 2/1994 Jessup et al. ..... 208/16
5,551,957 A 9/1996 Cunningham et al. ..... 44/347
5,593,567 A 1/1997 Jessup et al. ..... 208/46
5,653,866 A 8/1997 Jessup et al. ..... 208/46
5,817,605 A * 10/1998 Papay ..... 508/187
5,837,126 A 11/1998 Jessup et al. ..... 208/46
5,883,057 A 3/1999 Roell et al. ..... 508/469
6,030,521 A 2/2000 Jessup et al. ..... 208/17
6,039,772 A 3/2000 Orr ..... 44/359
6,258,761 B1 7/2001 Lange et al. ..... 508/452
6,423,671 B1 7/2002 Harvna ..... 508/365
6,482,777 B2 11/2002 Cain ..... 508/185

* cited by examiner

*Primary Examiner*—Ellen M. McAvoy
(74) *Attorney, Agent, or Firm*—Grossman, Tucker, et al.

(57) ABSTRACT

This invention includes a lubricant composition comprising a base oil and one or more additives, wherein the composition has an elevated pressure auto ignition temperature of at least about 500 K. This invention also includes a lubricant composition comprising a base oil and one or more additives, wherein the composition has an octane number ((R+M)/2) of at least about 80. This invention also includes a lubricant composition for reducing the propensity of end gas knock in a flame propagation engine, comprising: a base oil and one or more additives, wherein the composition has an average boiling point in excess of 200° C.

36 Claims, No Drawings

HIGH OCTANE LUBRICANTS FOR KNOCK MITIGATION IN FLAME PROPAGATION ENGINES

This application claims the benefit of U.S. Provisional Application No. 60/469,769, filed May 12, 2003.

BACKGROUND OF INVENTION

This invention pertains to lubricant oil compositions and processes that reduce the propensity for end gas knock in flame propagation engines.

Engine knock is a phenomenon that occurs in a flame propagation engine due to auto ignition of a portion of the fuel air mixture ahead of the propagating flame front. This auto ignition occurs very rapidly; possibly creating a detonation wave that traverses the end gas leading to the audible ping or knock. This phenomena limits performance in all flame propagation engines because it limits the intake manifold pressure, the engine compression ratio, and the spark advance, factors that all affect the engine performance, emissions, and efficiency. There is much research directed toward reducing knock. Compositions of fuels and lubricants and methods to prevent or reduce such knock in flame propagation engines are highly desirable.

SUMMARY OF INVENTION

Engine lube oil is intentionally coated on the cylinder line every stroke to reduce friction and to prevent ring and liner wear. Some of this lubricant enters the boundary layer of the cylinder and the combustion chamber in the end gas region. Typical lubricant base stocks have relatively high cetane number (and correspondingly low octane) or low auto-ignition temperatures. The boundary layer and the end gas region therefore consist of a mixture of fuel and air, at close to the air-fuel ratio of the main combustion chamber, and a relatively rich concentration of the lubricant. This means that the end gas auto-ignition temperature is lower, possibly significantly lower, than the fuel-air mixture in the middle of the combustion chamber. The present inventors have determined that a factor contributing to the early or undesirable onset of knock is the presence of lubricating oil in the end gas.

Engine lubricating oil comprises base oil, which may be either petroleum (mineral) based or synthetic, and a number of additive components. The additive components include organometallics used for wear prevention, friction reduction, and acid neutralization, various viscosity modifiers, dispersants, and detergents. The auto ignition temperature of the base oils are typically much lower than the fuel in flame propagation engines, where the fuel can include gasoline, natural gas, LP gas, and hydrogen, to name a few. This means that the octane number of the base lubricant is very low, meaning that if the end gas contains any lubricant, either as droplets or vapor, the auto ignition temperature of the end gas can be very low and knock can occur. The base stock formulation and the additives affect both the propensity of the oil to enter the end gas as well as the auto ignition temperature of the oil. The inventors herein have found that lube oil can be flung into the high temperature fuel and air zone where the lubricant droplets easily auto-ignite, and this can create knock. In addition, it has been found that the higher the acceleration of the engine, the greater the amount of lubricant entering the fuel and air zone.

The inventors have identified a number of factors that can be modified to reduce knock in the engine by for instance either limiting the amount of oil that enters the end gas region or by adjusting the octane number of the base oil and the fully formulated lubricant. These factors include, but are not limited to, the following: volatility of the lubricant, octane of the lubricant, viscosity of the lubricant, lube oil density, characteristics of the additive package (e.g., including additives for increasing the octane of the lubricant), and octane characteristics of the base stock.

By modifying the volatility and/or viscosity of the lubricant, one can affect the amount of lubricant vapor that enters the end gas region. For example, if a given lubricant has a low octane number relative to the octane of the fuel, a decrease of the lubricant's volatility and/or increasing the viscosity will result in less low octane lubricant droplets entering the end gas and thus lessen the octane reduction in the end gas then would otherwise result from the lubricant if it had a higher volatility and/or lower viscosity. The volatility of the lubricant can be modified by, for example, increasing the average boiling point of the base oil, or by the use of a narrower boiling range. The viscosity can be modified in a similar way, and/or by adding an additive to increase viscosity. Similarly, by modifying the density of the lubricant, one can affect the amount of lubricant that enters the end gas. Higher density lubricant will have less propensity to enter the end gas; thus, by employing higher density base oil, one can increase the density and thereby decrease the amount of low octane lubricant that enters the end gas, whereby the lubricant has less propensity to contribute to end gas knock. The propensity of end gas knock can also be affected by modifying the octane of the lubricant to above 80, by employing a lubricant formulation that has an elevated pressure auto ignition temperature ("EPAIT") of at least 500 K, and/or by employing a lubricant composition that has an average boiling point in excess of 200° C. It should be appreciated that EPAIT and octane number are somewhat inter-related such that an increase of a lubricant's EPAIT usually also increases the octane number.

Thus in one embodiment of this invention, the lubricant composition, which may comprise base oil and one or more additives, has an EPAIT of at least about 500 K. EPAIT may be measured by using a constant volume combustion bomb (an "IQT" device, which has been used previously to measure auto ignition characteristics such as the cetane number of diesel fuels) to determine the ignition delay time as a function of the initial air temperature in the IQT, such as described in "Fuel Requirements for HCCl Engine Operation," by Thomas W. Ryan III and Andrew C. Matheaus, which published as paper SAE 2003-01-1813 at the JSAE/SAE International Spring Fuels & Lubricants Meeting, Yokohama, Japan, May 19-22, 2003. This allows the development of the relationship between the ignition delay time and the test temperature or, conversely, the ignition temperature (the test temperature) as a function of the delay time. It should be appreciated that the ignition delay time-temperature relationship consistently shows an Arrhenius type of relationship. This relationship can be used to define the ignition temperature at any ignition delay time. This allows one to select an ignition delay time (e.g., 7 milliseconds) that would then be used to determine the temperature at which ignition occurred for a given fuel, i.e., to define the EPAIT. In general, the EPAIT can be raised to above 500 K (in one embodiment above 600 K) by increasing the EPAIT of the base oil such as by changing the composition of the base oil in question or by adding one or more EPAIT modifying additives to the base oil.

In one embodiment of this invention, the lubricant composition, which may comprise a base oil and one or more additives, has an octane number ((R+M)/2) of at least about 80. In one embodiment, the octane number is at least about 85. Octane can be measured using well known procedures. If the lubricant composition has an octane number below about 80, it can be increased in a number of ways, such as by raising the octane number of the base oil or by adding one or more additives that increases the octane of the composition. Representative examples of such additives include tetra ethyl lead and other organometallics such as "MMT." MMT is a commercially available octane improver additive for engine fuels.

In one broad respect, this invention is a lubricant composition for reducing the propensity of end gas knock in a flame propagation engine, comprising: a base oil and one or more additives, where the composition has (a) an octane number of at least about 80, (b) an elevated pressure auto ignition temperature of at least about 500 K, or (c) both (a) and (b).

In another broad respect, this invention is a process for reducing the propensity for end gas knock in a flame propagation engine, comprising: using a lubricant composition as the engine oil wherein the lubricant composition comprises a base oil and one or more additives, where the composition has (a) an octane number of at least about 80, (b) an elevated pressure auto ignition temperature of at least about 500 K, or (c) both (a) and (b).

In another broad respect, this invention is a process for manufacturing a lubricant composition that reduces the propensity for engine knock in a flame propagation engine, comprising: formulating a lubricant composition which comprises a base oil and one or more additives wherein the lubricant composition has (a) an octane number of at least about 80, (b) an elevated pressure auto ignition temperature of at least about 500 K, or (c) both (a) and (b).

In another broad respect, this invention is a method for identifying a lubricant composition that reduce the propensity for end gas knock in a flame propagation engine, comprising: subjecting a sample of a lubricant composition to (a) an elevated pressure auto ignition temperature test to determine whether the sample has an elevated pressure auto ignition temperature of at least about 500 K, (b) an octane number test to determine whether the sample as an octane number of at least about 80, or (c) both (a) and (b). The lubricant may comprise a base oil and one or more additives. This method may include the step of adding an octane-improver additive to increase the elevated pressure auto ignition temperature of the lubricant composition to at least about 500 K and/or octane number of the lubricant composition to at least about 80, and optionally including the step of subjecting the lubricant composition that contains the octane-increase additive to (a), (b), or (c).

In one embodiment of this invention, the lubricant composition, which may comprise a base oil and one or more additives, has an average boiling point in excess of 200° C.

In one broad respect, this invention is a lubricant composition for reducing the propensity of end gas knock in a flame propagation engine, comprising: a base oil and one or more additives, wherein the composition has an average boiling point in excess of 200° C.

In another broad respect, this invention is a process for reducing the propensity for end gas knock in a flame propagation engine, comprising: using a lubricant composition as the engine oil wherein the lubricant composition comprises a base oil and one or more additives, wherein the composition has a average boiling point in excess of 200° C.

In another broad respect, this invention is a process for manufacturing a lubricant composition that reduces the propensity for engine knock in a flame propagation engine, comprising: formulating a lubricant composition which comprises a base oil and one or more additives wherein the lubricant composition has an average boiling point in excess of 200° C.

In another broad respect, this invention is a method for identifying a lubricant composition that reduce the propensity for end gas knock in a flame propagation engine, comprising: subjecting a sample of a lubricant composition to a test to determine if the composition has an average boiling point in excess of 200° C. This method may include the step of adding an octane-improver additive to increase the EPAIT of the lubricant composition to be excess of 500° C., and optionally including the step of subjecting the lubricant composition that contains the octane-improver additive to a test to determine if the resulting lubricant composition has an EPAIT in excess of 500° C.

In all aspects of the invention, the base oil can be a natural oil; the base oil can be derived from coal or shale; the base oil can be a mineral oil; the base oil can be a synthetic oil; the base oil can be a polyalphaolefin oil; the base oil can be a polyester oil; the one or more additives can include at least one of an alcohol, an ether, an ester, an organometallic compound, or combination thereof; the one or more additives can include at least one of ferrocene, butyl ferrocene, or combination thereof; the one or more additives can include at least one of ethyl acetate, isoamyl acetate, amyl acetate, isoamyl propionate, isoamyl nonanoate, isobutyl acetate, isobutyl alcohol, methyl butyrate, methyl caproate, methyl caprylate, or combination thereof; the one or more additives can include at least one of cyclopentadienyl manganese tricarbonyl, methylcyclopentadienyl manganese tricarbonyl, ethylcyclopentadienyl manganese tricarbonyl, propylcyclopentadienyl manganese tricarbonyl, indenyl manganese tricarbonyl, methyl indenyl manganese tricarbonyl, fluorenyl manganese tricarbonyl, dimethylcyclopentadienyl manganese tricarbonyl, methylpropylcyclopentadienyl manganese tricarbonyl, phenylcyclopentadienyl manganese tricarbonyl, or combination thereof; the base oil can be present in the lubricant composition in an amount of from about 0.01% to about 99% by weight.; the base oil can be present in the lubricant composition in an amount of from about 0.1% to about 80% by weight; the one or more additives can be present in an amount of from about 0.01% to about 20% by weight; the one or more additives can be present in an amount of from about 0.1% to about 10% by weight; or any combination thereof.

The present invention has a number of advantages, including the ability to reduce the propensity of end gas knock in a flame propagation engine, without having to modify the engine fuel that is sent to the engine from the fuel tank.

DETAILED DESCRIPTION OF THE INVENTION

Base Oil

Unrefined, refined and rerefined oils, either natural or synthetic (as well as mixtures of two or more of any of these) can be used as the base oils in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products. Likewise, the oils may be made using a Fisher-Tropsch process.

Oils of lubricating viscosity derived from coal or shale are useful in the practice of this invention. Mineral oils are useful as the base oil in the practice of this invention. Mineral oils include petroleum oils, and treated petroleum oils. The mineral oils may be a paraffinic, naphthenic and/or aromatic types. Specific mineral oils include hydrotreated mineral oils, solvent refined mineral oils, isomerized wax oils, solvent refined and acid treated mineral oils, etc., wax basestocks, and 120 N isomerized wax basestocks.

The lubricating compositions of this invention employ an oil of lubricating viscosity, including natural or synthetic lubricating oils and mixtures thereof. Mixtures of mineral oil and synthetic oils, such as polyalphaolefin oils and polyester oils, may be used.

Synthetic lubricating oils include hydrocarbon oils and halosubstituted hydrocarbon oils such as polymerized and interpolymerized olefins, etc. and mixtures thereof, alkylbenzenes, polyphenyl, (e.g., biphenyls, terphenyls, alkylated polyphenyls, etc.), alkylated diphenyl ethers and alkylated diphenyl sulfides and their derivatives, analogs and homologues thereof and the like. Alkylene oxide polymers and interpolymers and derivatives thereof, and those where terminal hydroxyl groups have been modified by esterification, etherification, etc., constitute other classes of known synthetic lubricating oils that can be used. Another suitable class of synthetic lubricating oils that can be used comprises the esters of dicarboxylic acids and those made from C5 to C12 monocarboxylic acids and polyols or polyether polyols. Other synthetic lubricating oils include liquid esters of phosphorus-containing acids, polymeric tetrahydrofurans, alkylated diphenyloxides and the like.

Natural oils useful in making the inventive lubricants and functional fluids include animal oils and vegetable oils (e.g., lard oil, castor oil) as well as mineral lubricating oils such as liquid petroleum oils and solvent treated or acid-treated mineral lubricating oils of the paraffinic, naphthenic or mixed paraffinic/naphthenic types which may be further refined by hydrocracking and hydrofinishing processes and are dewaxed. Oils of lubricating viscosity derived from coal or shale are also useful. Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); poly(1-hexenes), poly-(1-octenes), poly(1-decenes), etc. and mixtures thereof, alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed C3-C8 fatty acid esters, or the C13 oxo acid diester of tetraethylene glycol.

Another suitable class of synthetic lubricating oils that can be used comprises the esters of dicarboxylic acid (e.g., phthalic acid, succinic acid, alkyl succinic acids, alkenyl succinic acids, maleic acid, azelaic acid, suberic acid, sebacic acid, furmaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacid acid with two moles of tetraethylene glycol and two moles of 2-ethylhexanoic acid and the like.

Esters useful as synthetic oils also include those made from C5 to C12 monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethlhexyl) silicate, tetra-(4-methyl-hexyisilicate, tetra-(p-tert-butylphenyl) silicate, hexyl-(4-methyl-2-pentoxy) disiloxane, poly(methyl) siloxanes, poly-(methylphenyl siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

In general the compositions of this invention contain from about 0.01% to about 99% by weight of the base oil. In one embodiment, the base oil can be present in the lubricant composition in an amount of from about 0.1% to about 90% by weight, and in another embodiment up to about 80% base oil.

Additives

Lubricating oil compositions of this invention contain additives. The selection of such additives will depend on the particular use. Any given additive may be included or excluded. Octane improvement additives can be employed in the practice of this invention. Additives that can be used as an octane booster include, but are not limited to, alcohols, ethers, esters, and organometallic compounds. Other known octane boosters also may be used. These additives can be used alone or together with others. Octane boosting and other additives may be present in the range of a few ppm to about 50% by weight. Representative non-limiting examples of non-organometallic octane boosters are ethyl acetate, isoamyl acetate, amyl acetate, isoamyl propionate, isoamyl nonanoate, isobutyl acetate, isobutyl alcohol, methyl butyrate, methyl caproate, and methyl caprylate.

An organometallic compound refers to a metal-containing compound whose molecules include carbon-metal linkage. Suitable organometallic compounds include any such compounds which are known to those of skill in the art to increase the octane rating of fuels such as tetra ethyl lead and methylcyclopentadienyl manganese tricarbonyl (MMT), which are used in the practice of this invention to increase octane of the lubricant composition. For example, organomanganese compounds and organo-iron compounds are especially suitable. Other metals may include, but are not limited to, metals of Groups IB, IIB, IIIB, IVB, VB, VIB, VIIB, and VIIIB of the Periodic Table of the Elements.

In some embodiments, ferrocene and butyl ferrocene are used as octane boosters. In other embodiments, an organometallic such as methylcyclopentadienyl manganese tricarbonyl ("MMT") is used as an octane booster. It should be understood that any organometallic compound that has a similar structure to ferrocene or MMT may be used as an octane booster. For example, metallocene compounds are such organometallic compounds.

The cyclopentadienyl manganese compounds useful in the method and compositions of his invention have the general formula: $Mn\,A\,(B)_3$ wherein A represents cyclomatic radical containing from 5 to 13 carbon atoms and B is a carbonyl.

The constituent designated by the symbol A in the formula comprises a cyclomatic radical, that is, a cyclopentadiene-type hydrocarbon radical which is a radical containing the cyclopentadienyl moiety. Generally such cyclomatic hydrocarbon groups contain 4 to 20 carbons, in one embodiment from 5 to 13 carbon atoms. Exemplary radicals are cyclopentadienyl, indenyl, methylcyclopentadienyl, propylcyclopentadienyl, diethylcyclopentadienyl, phenylcyclopentadienyl, tert-butylcyclopentadienyl, p-ethylphenylcyclopentadienyl, 4-tert-butyl indenyl and the like.

Representative compounds include cyclopentadienyl manganese tricarbonyl, methylcyclopentadienyl manganese tricarbonyl, ethylcyclopentadienyl manganese tricarbonyl, propylcyclopentadienyl manganese tricarbonyl, indenyl manganese tricarbonyl, methyl indenyl manganese tricarbonyl, fluorenyl manganese tricarbonyl, dimethylcyclopentadienyl manganese tricarbonyl, methylpropylcyclopentadienyl manganese tricarbonyl, phenylcyclopentadienyl manganese tricarbonyl and the like.

Lubricant compositions often comprise a zinc salt of a dithiophosphoric acid. Zinc salts of dithiophosphoric acids are often referred to as zinc dithiophosphates, zinc O,O-dihydrocarbyl dithiophosphates, and other commonly used names. They are sometimes referred to by the abbreviation ZDP. One or more zinc salts of dithiophosphoric acids may be present in a minor amount to provide additional extreme pressure, anti-wear and anti-oxidancy performance.

Other additives that may optionally be used in the lubricating oils of this invention include, for example, detergents, dispersants, supplemental viscosity improvers, oxidation inhibiting agents, corrosion inhibiting agents, pour point depressing agents, extreme pressure agents, anti-wear agents, color stabilizers and anti-foam agents. The above-mentioned dispersants and supplemental viscosity improvers may be used in addition to the nitrogen containing esters of this invention.

Extreme pressure agents and corrosion and oxidation inhibiting agents which may be included in the compositions of the invention are exemplified by chlorinated aliphatic hydrocarbons, organic sulfides and polysulfides, phosphorus esters including dihydrocarbon and trihydrocarbon phosphites, molybdenum compounds, and the like.

Other oxidation inhibiting agents include materials such as alkylated diphenyl amines, hindered phenols, especially those having tertiary alkyl groups such as tertiary butyl groups in the position ortho to the phenolic —OH group, and others.

Auxiliary viscosity improvers (also sometimes referred to as viscosity index improvers or viscosity modifiers) may be included in the compositions of this invention. Viscosity improvers are usually polymers, including polyisobutenes, polymethacrylic acid esters, hydrogenated diene polymers, polyalkyl styrenes, esterified styrene-maleic anhydride copolymers, hydrogenated alkenylarene-conjugated diene copolymers and polyolefins. Multifunctional viscosity improvers, other than those of the present invention, which also have dispersant and/or antioxidancy properties are known and may optionally be used in the practice of this invention.

Pour point depressants may be included in the additive concentrates and lubricating oils described herein. Those which may be used are described in the literature and are well-known.

Anti-foam agents used to reduce or prevent the formation of stable foam include silicones or organic polymers.

Detergents and dispersants may be of the ash-producing or ashless type. The ash-producing detergents are exemplified by oil soluble neutral and basic salts of alkali or alkaline earth metals with sulfonic acids, carboxylic acids, phenols or organic phosphorus acids characterized by a least one direct carbon-to-phosphorus linkage. Ashless detergents and dispersants are so-called despite the fact that, depending on its constitution, the detergent or dispersant may upon combustion yield a nonvolatile residue such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in British Patent number 1,306,529 and in many U.S. patents including the following:

| | | |
|---|---|---|
| 3,163,603 | 3,399,141 | 3,574,101 |
| 3,184,474 | 3,415,750 | 3,576,743 |
| 3,215,707 | 3,433,744 | 3,630,904 |
| 3,219,666 | 3,444,170 | 3,632,510 |
| 3,271,310 | 3,448,048 | 3,632,511 |
| 3,272,746 | 3,448,049 | 3,697,428 |
| 3,281,357 | 3,451,933 | 3,725,441 |
| 3,306,908 | 3,454,607 | 4,194,886 |
| 3,311,558 | 3,467,668 | 4,234,435 |
| 3,316,177 | 3,501,405 | 4,491,527 |
| 3,340,281 | 3,522,179 | 5,696,060 |
| 3,341,542 | 3,541,012 | 5,696,067 |
| 3,346,493 | 3,541,678 | 5,779,742 |
| 3,351,552 | 3,542,680 | RE 26,433 |
| 3,381,022 | 3,567,637 | |

(2) Reaction products of relatively high molecular weight aliphatic or alicyclic halides with amines, preferably polyalkylene polyamines. These may be characterized as "amine dispersants" and examples thereof are described for example, in the following U.S. patents:

| | |
|---|---|
| 3,275,554 | 3,454,555 |
| 3,438,757 | 3,565,804 |

(3) Reaction products of alkyl phenols in which the alkyl groups contains at least about 30 carbon atoms with aldehydes (especially formaldehyde) and amines (especially polyalkylene polyamines), which may be characterized as "Mannich dispersants". The materials described in the following U.S. patents are illustrative:

| | |
|---|---|
| 3,413,347 | 3,725,480 |
| 3,697,574 | 3,726,882 |
| 3,725,277 | |

(4) Products obtained by post-treating the carboxylic amine or Mannich dispersants with such reagents as urea, thiourea, carbon disulfide, aldehydes, ketones, carboxylic acids, hydrocarbon-substituted succinic anhydrides, nitrites, epoxides, boron compounds, phosphorus compounds or the like. Exemplary materials of this kind are described in the following U.S. patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |
| | | 4,234,435 | |

(5) Polymers and copolymers of oil-solubilizing monomers such as decyl methacrylate, vinyl decyl ether and high molecular weight olefins with monomers containing polar substituents, e.g., aminoalkyl acrylates or methacrylates, acrylamides and poly-(oxyethylene)-substituted acrylates. These may be characterized as "polymeric dispersants" and examples thereof are disclosed in the following U.S. patents:

| | |
|---|---|
| 3,329,658 | 3,666,730 |
| 3,449,250 | 3,687,849 |
| 3,519,565 | 3,702,300 |

The above-noted patents are incorporated herein by reference for their disclosures of ashless dispersants.

The above-illustrated additives may each be present in lubricating compositions at a concentration of as little as 0.001% by weight, usually ranging from about 0.01% to about 20% by weight. In most instances, they each contribute from about 0.1% to about 10% by weight, more often up to about 5% by weight.

Additive Concentrates

The various additives described herein can be added directly to the base oil or lubricant composition. However, the additives may be diluted with a substantially inert, normally liquid organic diluent such as mineral oil, naphtha, benzene, toluene or xylene, to form an additive concentrate. These concentrates usually comprise about 0.1 to about 80% by weight, frequently from about 1% to about 80% by weight, more often from about 10% to about 80% by weight, of the compositions of this invention and may contain, in addition, one or more other additives known in the art or described hereinabove. Concentrations such as 15%, 20%, 30% or 50% or higher may be employed.

Additive concentrates are prepared by mixing together the desired components, often at elevated temperatures, usually less than 100 C., often no more than about 70 C.

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as illustrative embodiments. Equivalent elements or materials may be substituted for those illustrated and described herein, and certain features of the invention may be utilized independently of the use of other features, all as would be apparent to one skilled in the art after having the benefit of this description of the invention.

What is claimed is:

1. A lubricant composition for reducing the propensity of end gas knock in a flame propagation engine cylinder, comprising: a polyester base oil and one or more additives, where the composition has (a) an octane number of at least about 80, (b) an elevated pressure auto ignition temperature of at least about 500 K, (c) an average boiling point in excess of 200° C., wherein the composition is formulated for use as a lubricant in conjunction with engine fuel and wherein the composition reduces propensity for end gas knock in a flame propagation engine without having to modify the engine fuel, wherein the one or more additives includes an organometallic compound.

2. The lubricant composition of claim 1, wherein the one or more additives includes at least one of cyclopentadienyl manganese tricarbonyl, methylcyclopentadienyl manganese tricarbonyl, ethylcyclopentadienyl manganese tricarbonyl, propylcyclopentadienyl manganese tricarbonyl, indenyl manganese tricarbonyl, methyl indenyl manganese tricarbonyl, fluorenyl manganese tricarbonyl, dimethylcyclopentadienyl manganese tricarbonyl, methylpropylcyclopentadienyl manganese tricarbonyl, phenylcyclopentadienyl manganese tricarbonyl, or combination thereof.

3. The lubricant composition of claim 1, wherein the base oil is present in the lubricant composition in an amount of from about 0.01% to about 99% by weight.

4. The lubricant composition of claim 1, wherein the base oil is present in the lubricant composition in an amount of from about 0.1% to about 80% by weight.

5. The lubricant composition of claim 1, wherein the one or more additives is present in an amount of from about 0.01% to about 20% by weight.

6. The lubricant composition of claim 1, wherein the one or more additives is present in an amount of from about 0.1% to about 10% by weight.

7. A process for reducing the propensity for end gas knock in a flame propagation engine cylinder, comprising: using a lubricant composition as the engine oil in said cylinder wherein the lubricant composition comprises a base oil and one or more additives, where the composition has (a) an octane number of at least about 80, (b) an elevated pressure auto ignition temperature of at least about 500 K, (c) an average boiling point in excess of 200° C., wherein the composition is formulated for use as a lubricant in conjunction with engine fuel and wherein the composition reduces the propensity for end gas knock in said cylinder of a flame propagation engine without having to modify the engine fuel, wherein the one or more additives includes an organometallic compound.

8. The process of claim 7, wherein the base oil is a natural oil.

9. The process of claim 7, wherein the base oils is derived from coal or shale.

10. The process of claim 7, wherein the base oil is a mineral oil.

11. The process of claim 7, wherein the base oil is a synthetic oil.

12. The process of claim 7, wherein the base oil is a polyalphaolefin oil.

13. The process of claim 7, wherein the base oil is a polyester oil.

14. The process of claim 7, wherein the one or more additives includes at least one of cyclopentadienyl manganese tricarbonyl, methylcyclopentadienyl manganese tricarbonyl, ethylcyclopentadienyl manganese tricarbonyl, propylcyclopentadienyl manganese tricarbonyl, indenyl manganese tricarbonyl, methyl indenyl manganese tricarbonyl, fluorenyl manganese tricarbonyl, dimethylcyclopentadienyl manganese tricarbonyl, methylpropylcyclopentadienyl manganese tricarbonyl, phenylcyclopentadienyl manganese tricarbonyl, or combination thereof.

15. The process of claim 7, wherein the base oil is present in the lubricant composition in an amount of from about 0.01% to about 99% by weight.

16. The process of claim 7, wherein the base oil is present in the lubricant composition in an amount of from about 0.1% to about 80% by weight.

17. The process of claim 7, wherein the one or more additives is present in an amount of from about 0.01% to about 20% by weight.

18. The process of claim 7, wherein the one or more additives is present in an amount of from about 0.1% to about 10% by weight.

19. A process for manufacturing a lubricant composition that reduces the propensity for engine knock in a flame propagation engine, comprising: formulating a lubricant composition which comprises a polyester base oil and one or more additives wherein the lubricant composition has (a) an octane number of at least about 80, (b) an elevated pressure auto ignition temperature of at least about 500 K, (c) an average boiling point in excess of 200° C., wherein the composition is formulated for use as a lubricant in conjunction with engine fuel and wherein the composition reduces propensity for end gas knock in a flame propagation engine without having to modify the engine fuel, wherein the one or more additives includes an organometallic compound.

20. The process of claim 19, wherein the one or more additives includes at least one of cyclopentadienyl manganese tricarbonyl, methylcyclopentadienyl manganese tricarbonyl, ethylcyclopentadienyl manganese tricarbonyl, propylcyclopentadienyl manganese tricarbonyl, indenyl manganese tricarbonyl, methyl indenyl manganese tricarbonyl, fluorenyl manganese tricarbonyl, dimethylcyclopentadienyl manganese tricarbonyl, methylpropylcyclopentadienyl manganese tricarbonyl, phenylcyclopentadienyl manganese tricarbonyl, or combination thereof.

21. The process of claim 19, wherein the base oil is present in the lubricant composition in an amount of from about 0.01% to about 99% by weight.

22. The process of claim 19, wherein the base oil is present in the lubricant composition in an amount of from about 0.1% to about 80% by weight.

23. The process of claim 19, wherein the one or more additives is present in an amount of from about 0.01% to about 20% by weight.

24. The process of claim 19, wherein the one or more additives is present in an amount of from about 0.1% to about 10% by weight.

25. A method for identifying a lubricant composition that reduces the propensity for end gas knock in a flame propagation engine, comprising: subjecting a sample of a lubricant composition to (a) an elevated pressure auto ignition temperature test to determine whether the sample has an elevated pressure auto ignition temperature of at least about 500 K, (b) an octane number test to determine whether the sample as an octane number of at least about 80, (c) a test to determine an average boiling point in excess of 200° C., wherein the composition is formulated for use as a lubricant in conjunction with fuel and wherein the composition reduces propensity for end gas knock in a flame propagation engine without having to modify the engine fuel, wherein the one or more additives includes an organometallic compound.

26. The method of claim 25, which includes adding an octane-increase additive to increase the elevated pressure auto ignition temperature of the lubricant composition to at least about 500 K and/or octane number of the lubricant composition to at least about 80, and optionally including the step of subjecting the lubricant composition that contains the octane-increase additive to (a), (b), or (c).

27. The method of claim 25, wherein the base oil is a natural oil.

28. The method of claim 25, wherein the base oils is derived from coal or shale.

29. The method of claim 25, wherein the base oil is a mineral oil.

30. The method of claim 25, wherein the base oil is a synthetic oil.

31. The method of claim 25, wherein the base oil is a polyalphaolefin oil.

32. The method of claim 25, wherein the base oil is a polyester oil.

33. The method of claim 25, wherein the base oil is present in the lubricant composition in an amount of from about 0.01% to about 99% by weight.

34. The method of claim 25, wherein the base oil is present in the lubricant composition in an amount of from about 0.1% to about 80% by weight.

35. The method of claim 25, wherein the one or more additives is present in an amount of from about 0.01% to about 20% by weight.

36. The method of claim 25, wherein the one or more additives is present in an amount of from about 0.1% to about 10% by weight.

* * * * *